US012345044B2

(12) United States Patent
Pospisil et al.

(10) Patent No.: US 12,345,044 B2
(45) Date of Patent: Jul. 1, 2025

(54) COMPOSITE STRUCTURE INCLUDING A STRUCTURAL PANEL AND A METAL SUPPORT

(71) Applicant: UNITED STATES GYPSUM COMPANY, Chicago, IL (US)

(72) Inventors: Frank Pospisil, Oak Park, IL (US); Yelena Straight, Libertyville, IL (US); James M. Ullett, Libertyville (CA); Kumar Natesaiyer, Grayslake, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 86 days.

(21) Appl. No.: 17/160,752

(22) Filed: Jan. 28, 2021

(65) Prior Publication Data

US 2021/0277653 A1 Sep. 9, 2021

Related U.S. Application Data

(60) Provisional application No. 62/986,398, filed on Mar. 6, 2020.

(51) Int. Cl.

| | |
|---|---|
| ***E04B 5/10*** | (2006.01) |
| ***E04B 5/04*** | (2006.01) |
| ***E04B 7/22*** | (2006.01) |
| ***E04C 2/06*** | (2006.01) |
| ***E04C 2/28*** | (2006.01) |
| ***E04C 2/32*** | (2006.01) |
| *E04B 1/24* | (2006.01) |

(52) U.S. Cl.
CPC ..... *E04B 5/10* (2013.01); *E04B 5/04* (2013.01); *E04B 7/22* (2013.01); *E04C 2/06* (2013.01); *E04C 2/28* (2013.01); *E04C 2/322* (2013.01); *E04B 2001/2484* (2013.01)

(58) Field of Classification Search
CPC ... E04C 2/06; E04C 2/28; E04C 2/322; E04C 2/324; E04B 5/04; E04B 5/10; E04B 5/40; E04B 7/22; E04B 2001/2484
See application file for complete search history.

(56) References Cited

U.S. PATENT DOCUMENTS 2,001,733 A * 5/1935 Kellogg ..... E04B 1/82 52/404.3
2,694,475 A * 11/1954 Crafton ..... E04B 5/10 52/503

(Continued)

FOREIGN PATENT DOCUMENTS

JP 51125975 A 11/1976
JP 08246609 A 9/1996

(Continued)

OTHER PUBLICATIONS

WO App. No. PCT/US2021/019665 International Search Report and Written Opinion dated May 14, 2021 (13 pages).

(Continued)

*Primary Examiner* — Jessie T Fonseca
(74) *Attorney, Agent, or Firm* — Greer, Burns & Crain, Ltd; Philip T. Petti; Pradip Sahu

(57) ABSTRACT

A composite structure for a building that includes at least one structural panel and at least one metal corrugated panel, where the at least one structural panel is secured to said at least one metal corrugated panel.

13 Claims, 5 Drawing Sheets

(56) References Cited

U.S. PATENT DOCUMENTS 2,887,192 A * 5/1959 Blaski ..... E04D 3/3606 52/506.1
3,094,813 A * 6/1963 Van Rensselaer ..... E04B 5/40 52/537
3,561,184 A * 2/1971 Saxe ..... E04B 5/40 52/630
3,596,421 A * 8/1971 Miller ..... E04B 5/40 52/333
4,059,936 A * 11/1977 Lukens ..... E04D 3/352 52/764
4,106,249 A * 8/1978 Morton ..... E04B 5/40 52/336
4,259,822 A * 4/1981 McManus ..... E04B 1/164 52/336
4,274,239 A * 6/1981 Carroll ..... E04B 7/00 52/309.8
4,393,634 A * 7/1983 McDermott ..... E04D 5/02 52/309.1
4,653,237 A * 3/1987 Taft ..... E04B 5/40 52/693
4,700,519 A * 10/1987 Person ..... E04B 5/40 52/334
4,741,138 A * 5/1988 Rongoe, Jr. ..... E04B 5/40 52/336
4,837,994 A * 6/1989 Stohs ..... H02G 3/283 52/220.4
5,088,259 A * 2/1992 Myers ..... E04D 11/02 52/410
5,632,126 A * 5/1997 Agsten ..... E04B 2/8635 52/106
5,842,315 A * 12/1998 Lin ..... B32B 3/18 52/630
5,941,035 A * 8/1999 Purse ..... E04B 5/40 52/263
6,141,932 A * 11/2000 Tarrant ..... E04B 5/40 52/409
6,742,315 B2 6/2004 Linn
6,986,812 B2 1/2006 Dubey et al.
7,445,738 B2 11/2008 Dubey et al.
7,493,738 B2 2/2009 Bui
7,670,520 B2 3/2010 Dubey
7,789,645 B2 9/2010 Dubey et al.
7,841,148 B2 * 11/2010 Tonyan ..... B28B 1/522 106/735
7,849,648 B2 12/2010 Tonyan et al.
8,030,377 B2 10/2011 Dubey et al.
9,249,572 B2 2/2016 Neumayr
9,435,465 B1 * 9/2016 Kirschner ..... F24F 13/0254
10,184,253 B1 * 1/2019 Ryan ..... E04D 13/172
2004/0040256 A1 * 3/2004 Bui ..... E04C 2/06 52/782.1
2004/0040257 A1 * 3/2004 Bui ..... E04C 2/28 52/782.1
2004/0250482 A1 12/2004 Jacobson et al.
2005/0066609 A1 * 3/2005 Olah ..... E04B 5/14 52/633
2006/0144005 A1 * 7/2006 Tonyan ..... E04B 5/10 52/653.1
2008/0000178 A1 * 1/2008 Hsu ..... E04B 5/40 52/745.19
2009/0000246 A1 * 1/2009 Chang ..... E04C 2/36 52/783.11
2010/0275544 A1 * 11/2010 Studebaker ..... F16B 25/0047 52/582.1
2011/0113714 A1 * 5/2011 Hsu ..... E04C 3/294 52/434
2013/0008112 A1 * 1/2013 Studebaker ..... F16B 35/048 52/321
2014/0000206 A1 * 1/2014 Studebaker ..... F16B 33/06 52/650.3
2014/0075875 A1 * 3/2014 Dayton ..... E04B 5/40 52/655.1
2014/0130435 A1 * 5/2014 Paradis ..... E04C 2/296 156/60
2014/0260036 A1 * 9/2014 Freeman ..... E04D 7/00 52/412
2015/0027071 A1 * 1/2015 Studebaker ..... E04C 5/08 52/223.6
2015/0184379 A1 * 7/2015 Studebaker ..... F16B 25/103 52/745.05
2016/0201346 A1 * 7/2016 Nunley ..... E04G 23/0218 52/745.21
2017/0081851 A1 * 3/2017 Kralic ..... E04B 1/14
2018/0163396 A1 * 6/2018 Boyles ..... B32B 5/18
2019/0242134 A1 * 8/2019 Nunley ..... E04D 3/352
2020/0087917 A1 * 3/2020 Billings ..... E04D 12/002

FOREIGN PATENT DOCUMENTS

JP 09234568 A 9/1997
JP 11350644 A 12/1999
JP 2001098688 A 4/2001
JP 2001348993 A 12/2001
JP 2008527205 A 7/2008
JP 2016000928 A 1/2016
WO 2006073723 A2 7/2006

OTHER PUBLICATIONS

Japanese Notice of Reasons for Refusal [2022-547946]: English translation dated Oct. 29, 2024 (12 pages).

* cited by examiner

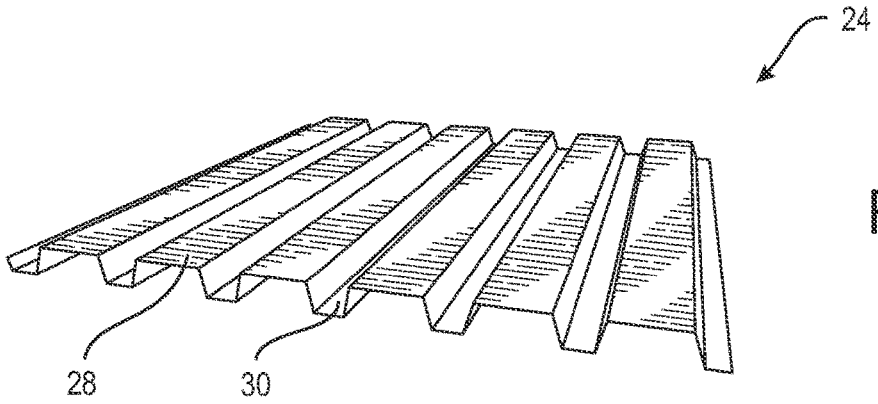
FIG. 3
FIG. 4
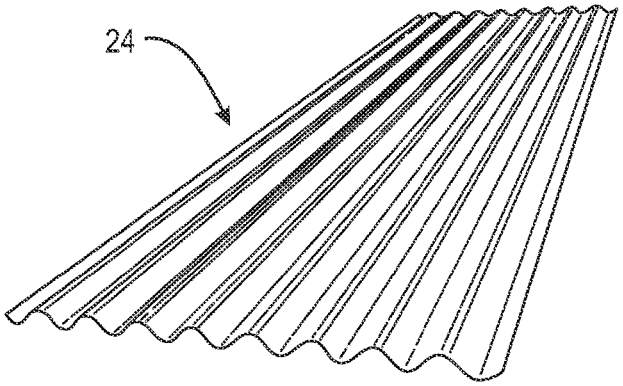
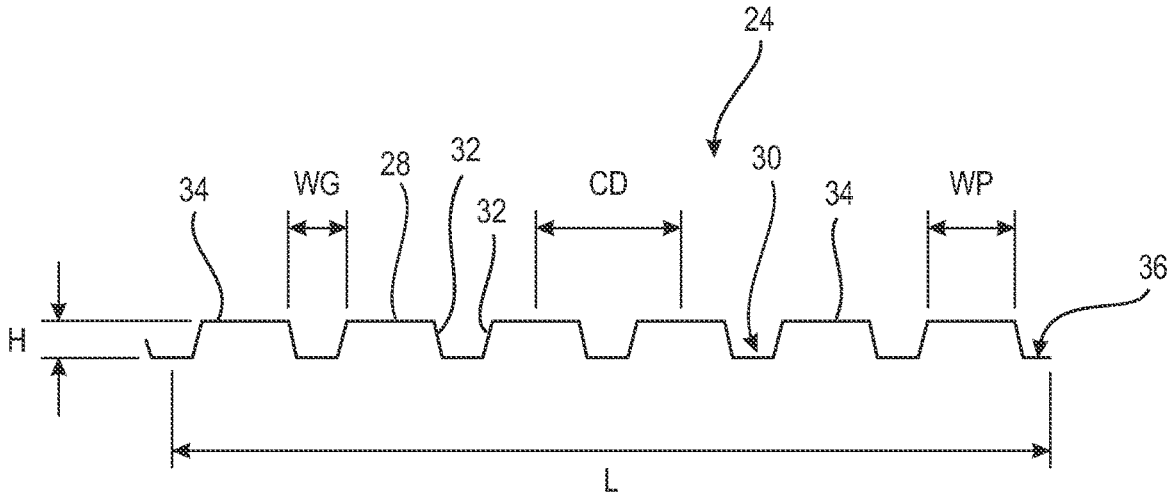
FIG. 5

COMPOSITE STRUCTURE INCLUDING A STRUCTURAL PANEL AND A METAL SUPPORT

CROSS REFERENCE TO RELATED APPLICATIONS

The present non-provisional application claims priority to and the benefit of U.S. Provisional Application No. 62/986,398 filed on Mar. 6, 2020, the entire contents of which is incorporated herein.

BACKGROUND

The present invention relates generally to structural materials used for constructing buildings, and more specifically, to a composite structure for constructing floors and roofs of residential and commercial buildings.

Many residential and commercial buildings use cementitious structural panels in constructing floors and roofs in noncombustible buildings where the cementitious panels are supported and secured to steel supports, such as I-beams or trusses, or a steel frame. Corrugated steel decks are also used in constructing the floors and roofs of these buildings. The steel decks are typically secured to a steel frame formed with structural supports to form roofs on residential or commercial buildings. Also, the steel decks are sometimes combined with poured concrete to form a floor in a building, where the decks in the floors may or may not be secured to steel supports or a steel frame.

For conventional floor construction in noncombustible buildings with cementitious panels, the cementitious panels are fastened to supports or a support frame, where the supports are typically spaced apart at twenty-four inches on center, i.e., twenty-four inches between the centers of adjacent supports. For roof structures made with cementitious panels, the supports are spaced up to forty-eight inches on center. The spacing of the supports is based on the structural strength of the cementitious panels.

High gauge steel decks are used primarily for constructing roofs on buildings. One issue with steel decks on roofs is that the steel decks are prone to corrosion and damage from hail due to exposure to environmental elements. Although the steel decks are inexpensive, they suffer from poor longevity and typically require frequent repairs.

Steel decks are also used in conjunction with poured concrete in floors in high-rise buildings. There are some significant issues with constructing floors with steel deck and concrete. For example, the steel deck and concrete floors are difficult to coordinate due to the relatively long setting time of the concrete. The relatively long setting time also makes installing these floors time consuming and expensive. Additionally, floors made with the steel deck and concrete are very heavy and require extra steel supports just to carry the dead load of these floors. The extra steel supports increase the material and labor costs associated with these floors.

Based on the above factors, floors made with cementitious panels or steel deck are inefficient, as these floors are more expensive relative to other floor systems in low-rise wood buildings or pure poured concrete floors in high-rise buildings. Additionally, roofs constructed with steel decks do not last long and typically require expensive repairs and replacement over time.

Thus, there is a need for a composite structure for constructing buildings that has sufficient strength to support building materials while requiring less labor and material costs than conventional building structures.

SUMMARY

The above-listed need is met or exceeded by the present composite structure made of a structural panel secured to a metal support, where the composite structure has a structural strength that is greater than conventional building materials.

In an embodiment, a composite structure for a building is provided and includes at least one structural panel and at least one metal corrugated panel, where the at least one structural panel is secured to said at least one metal corrugated panel.

In another embodiment, a floor structure for a building is provided and includes a plurality of supports that are spaced apart so that the distance between the centers of the plurality of supports is greater than twenty-four inches on center and at least one composite structure secured to the plurality of supports, where the composite structure includes at least one structural panel attached to a corrugated steel sheet.

In a further embodiment, a roof structure for a building is provided and includes a plurality of supports that are spaced apart so that the distance between the centers of the plurality of supports is greater than forty-eight inches and at least one composite structure is secured to the plurality of supports, where the composite structure includes at least one structural panel attached to a corrugated steel sheet.

BRIEF DESCRIPTION OF THE DRAWINGS

FIG. 3 is a perspective view of an embodiment of the metal support;

FIG. 4 is a perspective view of another embodiment of the metal support;

FIG. 5 is a schematic view of a cross-section of a metal support used in the present composite structure;

DETAILED DESCRIPTION

Figure 1:
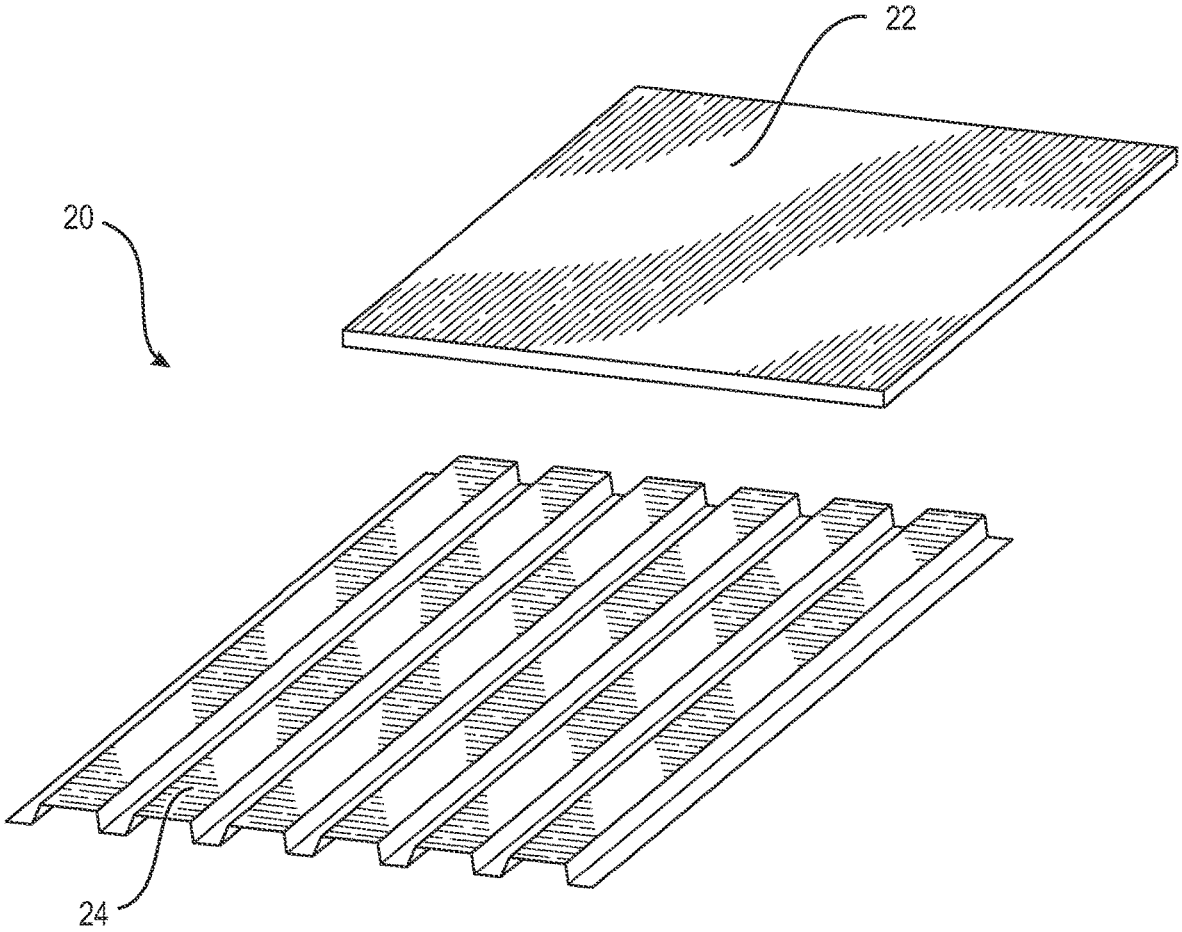
FIG. 1 is an exploded perspective view of the present composite structure.
Figure 2:
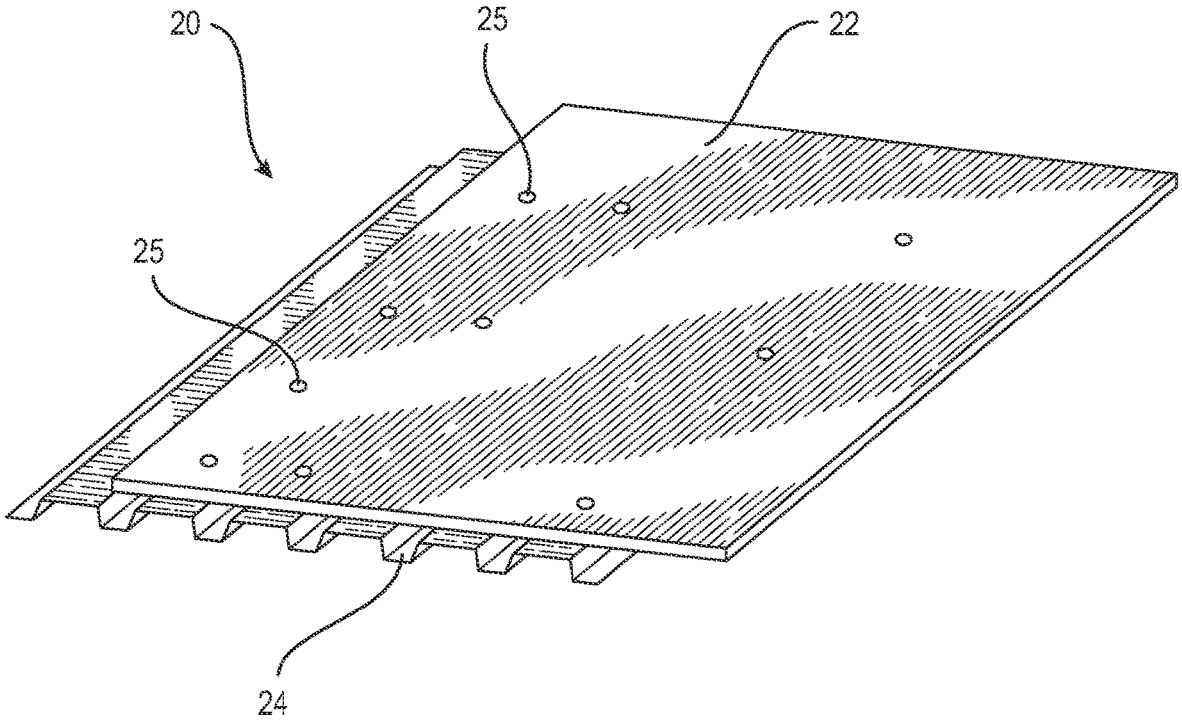
FIG. 2 is a perspective view of the composite structure of FIG. 1 where a cementitious panel is attached to a metal support.

Referring now to FIG. 1, the present composite structure 20 includes a combination of materials to form a floor or ceiling in a residential or commercial building. The composite structure may also be used to construct one or more walls in a building. In an embodiment, the composite structure 20 includes a building panel, and more specifically, a cementitious panel 22 secured to a metal support 24 by fasteners 25, such as screws or bolts. The cementitious panel 22 is a structural cementitious panel as described in U.S. Pat. Nos. 6,986,812; 7,445,738; 7,670,520; 7,789,645; and 8,030,377, which are all incorporated herein by reference. It should be appreciated that the panel 22 may be a Portland-based cementitious panel, a magnesium oxide based cementitious panel or any suitable cementitious panel or a panel made of any suitable material or combination of materials. In an embodiment, the cementitious panel 22 is made of a cement-gypsum binder including alkali-resistant fiberglass fibers. As shown in FIGS. 1 and 2, one or more of the cementitious panels 22 are attached to the metal support 24 to form the composite structure 20. The cementitious panels 22 preferably have a length of eight feet, a width of four feet and a thickness of a ½ inch (0.5 inches). It should be appreciated that the cementitious panels 22 may be have any suitable length and width. Further, the cementitious panels may have a thickness of: ¼ inch (0.25 in), ⅜ inches (0.375 inches), ½ inch (0.5 inch), ⅝ inch (0.625 inch), ¾ inch (0.75 in), 1.0 in or any suitable thickness.

Figure 6:
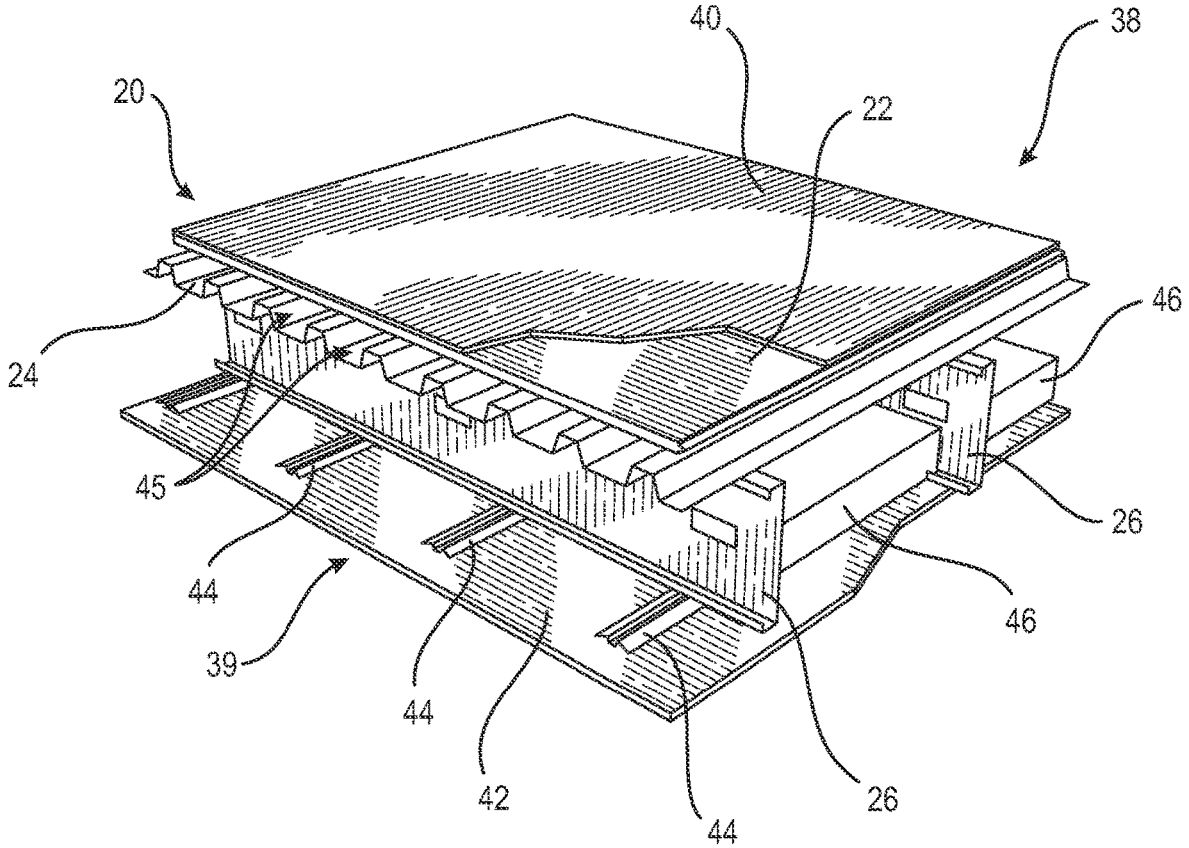
FIG. 6 is a perspective view of the composite structure of FIG. 1 attached to a support frame of a floor.

The metal support 24 is preferably a steel panel that extends over two or more structural supports such as the steel joists 26 shown in FIG. 6. In another embodiment, the metal support extends over two or more steel trusses (not shown). In the illustrated embodiment, the steel panel 24 has a width of four feet and a length of eight feet. It should be appreciated that the steel panel may be any suitable size and shape and have any suitable dimensions. In the illustrated embodiment, the steel panel is a corrugated steel sheet having a plurality of protruding members 28 and a plurality of grooves 30 formed between the protruding members. As shown in FIGS. 1, 3 and 5, each of the protruding members 28 has opposing angled sidewalls 32 and a relatively flat top wall 34 extending between the sidewalls. It should be appreciated that the sidewalls 32 of the protruding members 28 may be slanted or angled at any suitable designated angle relative to the bottom surface 36 of the steel panel. It should also be appreciated that the sidewalls 32 of the protruding members 28 are parallel to each other. In an embodiment, the sidewalls 32 of the protruding members 28 of the steel panels 24 shown in FIG. 1 form an angle that is greater than 90 degrees relative to the bottom surface 36 of the steel panel. In another embodiment, the sidewalls 32 of the protruding members 28 are parallel to each other, i.e., straight sidewalls that form a 90-degree angle relative to the bottom surface. In a further embodiment, the protruding members 28 and the grooves 30 have a curved or rounded shape as shown in FIG. 5. It is contemplated that the sidewalls 32 of the protruding members 28 may be any suitable size or shape and form any suitable angle relative to the bottom surface 36 of the steel panel.

Further, as shown in FIGS. 1, 2, 3 and 5, the width (WP) of each of the protruding members 28 is greater than the width (WG) of the grooves 30. The size, shape and height of the protruding members 28 and the widths of the protruding members relative to the grooves 30 are determined based on the size of the steel panels 24, the span of the steel panels 24 on the underlying structural frame or supports, the desired strength of the attachment or bond of the cementitious panels 22 on the steel panels 24 and other desired structural properties such as sound dampening. For example, increasing the number of protruding members 28 on the steel panels 24, increases the surface area that the cementitious panels 22 may be fastened to, which increases the strength of attachment or bond between the cementitious panels and the steel panels. As another example, increasing the widths (WG) of the grooves 30 between the protruding members 28 increases the air space between the cementitious panels 22 and the steel panels 24, which helps to decrease traveling of sound and vibration noise through the composite structure for sound and vibration dampening.

Also as shown in FIG. 5, each of the steel panels 24, and more specifically, the steel corrugated sheets, has an overall length (L). The protruding members 28 of the corrugated steel sheets each have width (WP), a height (H) and a center distance (CD), which is the distance between the centers of adjacent protruding members. Further, the width (WG) of the grooves 30 is the distance between the sidewalls of adjacent protruding members 28. It should be appreciated that the dimensions of the protruding members 28, the grooves 30 and the corrugated steel sheet or steel panel 24, may be any suitable dimensions based on the desired structural properties of the corrugated steel sheet and the composite structure 20 as described above.

Referring to FIG. 2, the composite structure 20 is made by attaching the cementitious panel 22 to the metal support or steel panel 24, which is preferably a corrugated steel sheet or corrugated steel deck, using fasteners. Alternatively, the cementitious panel 22 may be attached to the steel panel 24 using an adhesive or a combination of adhesive and fasteners. In an embodiment, the composite structure 20 is prefabricated by securing at least one of the cementitious panels 22 to the corrugated steel sheet 24 by installing fasteners through the cementitious panel 22 and into one or more of the protruding members 28 of the corrugated steel sheet 24 along the width and/or length of the cementitious panel. One or more of the prefabricated composite structures 20 is then transported to a job site where the composite structures are attached to a support frame, such as the steel trusses 26 shown in FIGS. 6 and 7, to form a floor or a roof in a building. It should be appreciated that the composite structure 20 may be attached to a metal frame or metal supports, a wood frame or wood supports, a plastic frame or plastic supports or any suitable frame or supports. In another embodiment, the cementitious panels 22 and the corrugated steel sheets 24 are transported to a job site and the cementitious panels are secured to the corrugated steel sheets at the job site to form the composite structures.

An embodiment of a floor 38 of a building that includes the present composite structure 20 is shown in FIG. 6, where the floor is placed on a supporting frame structure 26, which also supports a finished ceiling 39 described below. The ceiling includes one or more layers of gypsum wallboard panels 42, such as cementitious panels or other suitable materials, and several resilient channel members 44 supporting the ceiling 39. The floor 38 may or may not have the resilient channel members 44. Typically, the floor 38 includes a plurality of structural supports, such as the steel trusses or I-beams 26, shown in FIG. 6. As stated above, conventional structural supports are usually spaced twenty-four inches on center, i.e., from a center of a structural support to a center of an adjacent structural support. However, using the present composite structure 20 in constructing the floor, which has greater structural strength than conventional building materials, the structural supports 26 may be spaced forty-eight inches on center or greater. Being able to increase the spacing between the structural supports 26 saves significant material and labor costs as well as time. Additionally, as stated above, the air spaces 45 formed between the cementitious panels 22 and the corrugated steel sheets 24 in the composite structure 20 dampen the sound and vibration traveling through the floor 38, which enhances the sound proofing properties of the floor using the present composite structure 20. As shown in FIG. 6, an insulating material 46, such as fiber glass insulation, may be inserted between the structural supports 26 for temperature control and/or further sound dampening. In the illustrated embodiment, an underlayment 40 is placed on the top surface of the cementitious panels to form a base for a finishing material, such as wood planks, tile or other suitable finishing material. The underlayment may be a poured material, such as poured concrete, or wood, such as plywood panels, or another suitable material.

Figure 7:
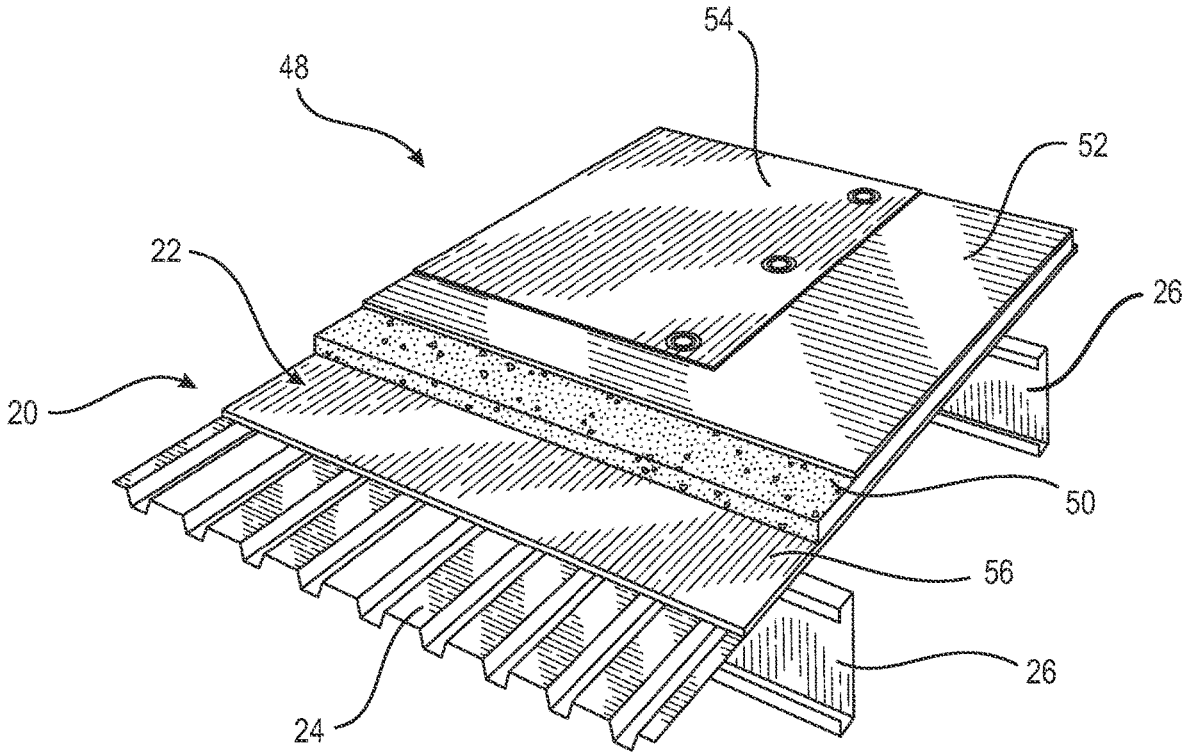
FIG. 7 is a perspective view of the composite structure of FIG. 1 attached to a support frame of a roof.

An embodiment of a roof structure or roof 48 including the present composite structure 20 is shown in FIG. 7. In the illustrated embodiment, one or more sections of the composite structure 20 is secured to structural supports such as the steel trusses 26. In conventional roof structures, the steel supports or trusses 26 are typically spaced forty-eight inches on center to sufficiently support conventional building materials. Using the present composite structure 20, the steel supports/trusses 26 may be spaced up to sixty inches to seventy-two inches on center. Similar to the floor 38 above, the increase in spacing between the steel supports 26, decreases the materials needed for the roof 48 thereby significantly decreasing the material and labor costs associated with the roof. In the roof 48 shown in FIG. 7, roofing materials are attached to the composite structure 20. For example, in this embodiment, an insulating material 50, a roof cover board 52 and a membrane or water-resistant material 54 are secured to a top surface 56 of the composite structure 20. It should be appreciated that the insulating material 50, the roof cover board 52 and membrane 54 may be attached directly to the composite structure 20 or any combination of these materials may be attached to the composite structure 20 based on the desired structure of the roof. It should also be appreciated that any suitable material or materials may be secured to the composite structure to form the roof. Additionally, roofing finishing materials, such as a roofing membrane, fiberglass, metal or wood shingles, may be secured to membrane 54 to form the top surface of the roof 50. Alternatively, the roofing finishing materials may be secured directly to the top surface 56 of the composite structure 20.

While particular embodiments of the present composite structure have been described herein, it will be appreciated by those skilled in the art that changes and modifications may be made thereto without departing from the invention in its broader aspects and as set forth in the following claims.

The invention claimed is:

1. A pre-fabricated composite structure for a building, the pre-fabricated composite structure consisting essentially of:

at least one pre-fabricated, structural cementitious panel having opposing sides and a length and a width, said at least one pre-fabricated, structural cementitious panel further having no reinforcing members; and a single integral metal corrugated panel having a plurality of protruding members and grooves, wherein the grooves are between the protruding members and the protruding members and the grooves each have upper surfaces that are spaced from each other, the single integral metal corrugated panel having a length and a width that is the same as the length and the width of said at least one pre-fabricated, structural cementitious panel, one of said sides of said at least one pre-fabricated structural cementitious panel being secured directly to the upper surfaces of some of said protruding members of said at least one single integral metal corrugated panel, wherein the at least one pre-fabricated, structural cementitious panel is spaced from the upper surfaces of said grooves, wherein said at least one pre-fabricated, structural cementitious panel and said single integral metal corrugated panel are offset relative to each other so that a portion of said at least one pre-fabricated, structural panel extends outwardly from an end of said single integral metal corrugated panel.

2. The composite structure of claim 1, wherein said at least one pre-fabricated, structural cementitious panel is a magnesium oxide-based cementitious panel.

3. The composite structure of claim 1, wherein said single integral metal corrugated panel is a steel corrugated panel.

4. The composite structure of claim 1, wherein a width of each of said protruding members is greater than a width of each of said grooves.

5. The composite structure of claim 1, wherein a width of each of said grooves is greater than a width of each of said protruding members.

6. The composite structure of claim 1, wherein each of said protruding members has angled opposing sidewalls and a top wall extending between said sidewalls.

7. The composite structure of claim 1, wherein each of said protruding members has parallel opposing sidewalls and a top wall extending between said sidewalls.

8. The composite structure of claim 1, wherein said protruding members and said grooves each have a curved shape.

9. The composite structure of claim 1, further comprising an insulating material secured to a surface of said at least one pre-fabricated, structural cementitious panel.

10. The composite structure of claim 9, further comprising one of a glass-mat roof board or a water-resistant membrane secured to said insulating material.

11. The composite structure of claim 1, further comprising one of a glass-mat roof board or a water-resistant membrane secured to said at least one pre-fabricated, structural cementitious panel.

12. A floor structure for a building, the floor structure comprising:

a plurality of supports that are spaced apart so that the distance between the centers of the plurality of supports is greater than twenty-four inches on center; and at least one pre-fabricated composite structure secured to said plurality of supports, said composite structure including at least one pre-fabricated, structural cementitious panel having opposing sides and a length and a width, said at least one pre-fabricated, structural cementitious panel further having no reinforcing members; and at least one single integral corrugated steel sheet including a plurality of protruding members and grooves formed between said protruding members, said protruding members and said grooves each having upper surfaces that are spaced from each other, wherein one of said sides of said at least one pre-fabricated, structural cementitious panel is attached directly to some of the upper surfaces of said single integral corrugated steel sheet by a plurality of fasteners, said at least one single integral corrugated steel sheet having a length and a width that is the same as the length and the width of said at least one pre-fabricated, structural cementitious panel, wherein the at least one pre-fabricated, structural cementitious panel is spaced from the upper surfaces of said grooves, and wherein said at least one pre-fabricated, structural cementitious panel and said single integral corrugated steel sheet are offset relative to each other so that a portion of said at least one pre-fabricated, structural panel extends outwardly from an end of said single integral corrugated steel sheet.

13. A roof structure for a building, the roof structure comprising:

a plurality of supports that are spaced apart so that the distance between the centers of the plurality of supports is greater than forty-eight inches; and at least one pre-fabricated composite structure secured to said plurality of supports, said composite structure including at least one pre-fabricated, structural cementitious panel having opposing sides and a length and a width, said at least one pre-fabricated, structural cementitious panel further having no reinforcing members; and at least one single integral corrugated steel sheet including a plurality of protruding members and grooves formed between said protruding members, said protruding members and said grooves each having upper surfaces that are spaced from each other, wherein one of said sides of said at least one pre-fabricated, structural cementitious panel being attached directly to some of the upper surfaces of said single integral corrugated steel sheet by a plurality of fasteners, said single corrugated steel sheet having a length and a width that are the same as the length and the width of said at least one pre-fabricated, structural cementitious panel, wherein the at least one pre-fabricated, structural cementitious panel is spaced from the upper surfaces of said grooves, and wherein said at least one pre-fabricated, structural cementitious panel and said at least one single integral corrugated steel sheet are offset relative to each other so that a portion of said at least one pre-fabricated, structural panel extends outwardly from an end of said at least one single integral corrugated steel sheet.

* * * * *